US012480734B2

(12) United States Patent
Douglas

(10) Patent No.: US 12,480,734 B2
(45) Date of Patent: Nov. 25, 2025

(54) ELECTRICALLY-POWERED FIREARM TRAINING DEVICE

(71) Applicant: Joshua Douglas, Ormond Beach, FL (US)

(72) Inventor: Joshua Douglas, Ormond Beach, FL (US)

( * ) Notice: Subject to any disclaimer, the term of this patent is extended or adjusted under 35 U.S.C. 154(b) by 596 days.

(21) Appl. No.: 17/979,892

(22) Filed: Nov. 3, 2022

(65) Prior Publication Data

US 2024/0151488 A1 May 9, 2024

(51) Int. Cl.
*F41A 33/00* (2006.01)

(52) U.S. Cl.
CPC ..... *F41A 33/00* (2013.01)

(58) Field of Classification Search
CPC ..... F41A 33/00
See application file for complete search history.

*Primary Examiner* — Robert P Bullington, Esq.
(74) *Attorney, Agent, or Firm* — J. Wiley Horton

(57) ABSTRACT

An electrically powered firearm training device with two main components—a simulator barrel assembly and a simulator magazine assembly. The simulator barrel assembly replaces the firearm's conventional barrel. The simulator magazine assembly replaces the firearm's conventional magazine. The simulator barrel assembly includes an electric motor that controllably moves a traveler using a jackscrew. The traveler cycles the slide in order to simulate the normal operation of the firearm. Electrical power is supplied to the motor from batteries within the simulator magazine.

20 Claims, 10 Drawing Sheets

ELECTRICALLY-POWERED FIREARM TRAINING DEVICE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of firearms. More specifically, the invention comprises an electrically-powered firearm training device that can be installed in a conventional firearm and subsequently removed to restore the normal operation of that firearm.

2. Description of the Related Art

Firearm training with live ammunition is both expensive and dangerous. It is therefore desirable to conduct training without actually having to fire a weapon. However, such training does not allow the trainee to realistically operate the firearms controls and thereby gain an instinctive familiarity with them. This is particularly true for semiautomatic pistols, where the user must master the operation of a trigger, a magazine release, the operation of replacing a spent magazine itself, and the release of a slide that has locked back after the firing of the last round in a magazine.

Weapon simulators that are useful only in training can perform many of these desired functions. These are expensive, however, since they are only useful in training and therefore require a law enforcement department to purchase an actual firearm and a separate simulator that mimics that firearm.

A better approach is to provide a simulation system that can be used in an actual firearm, then removed to restore the firearm to its normal state. Such an approach is described in U.S. Pat. No. 8,602,784 to Dvorak. The Dvorak device uses air pressure to operate the slide of a pistol and simulate its firing. This approach requires the user to "recharge" the system using compressed air.

The present invention provides an electrical actuation system. The inventive system can be easily recharged and reused many times. The inventive system also allows a more realistic operation—as the depletion of an actual magazine can be better simulated.

The invention can be altered and adapted to fit a wide variety of firearms, but it is particularly well suited to semi-automatic pistols. Such weapons will be well known to those skilled in the art. An exemplary weapon is disclosed in U.S. Pat. No. 984,519 to John M. Browning (the Browning "1911" pistol). The invention can be used with 1911-type pistols in which the locking of the barrel to the slide is controlled by a pivoting link.

A second exemplary weapon is disclosed in U.S. Pat. No. 1,618,510 to John M. Browning (the Browning "Hi Power" pistol). The Hi Power uses a fixed barrel lug to lock the barrel to the slide. Many subsequent designs have used this approach. A more recent design incorporating this approach has been patented by Heckler and Koch as U.S. Pat. No. 5,799,434. The '434 patent describes a Heckler and Koch Military and Police Pistol ("MP"). More recent evolutions of this design are known as the Heckler and Koch Universal Self-Loading Pistol ("USP"). A simplified depiction of the USP is shown in the drawing figures of this disclosure.

The invention is not limited in its application to the USP, however. The invention can be adopted for use in practically any firearm—including the 1911 Browning, the Browning Hi-Power, the Beretta 92/M9 (as described in U.S. Pat. No. 5,596,162), and the Glock family of pistols (to name a few). U.S. Pat. Nos. 984,519; 1,618,510; 5,799,434; and 5,596,162 are hereby all incorporated by reference.

The installation and operation of the invention will be described with respect to a Heckler and Koch USP semi-automatic pistol. In order to benefit the reader's understandings, the conventional operation of this pistol is depicted in FIGS. 1-3. FIG. 1 shows pistol 10. Frame 12 provides an attachment point for the other components. Slide 14 slides fore and aft on rails that interlock with corresponding features on frame 12. Grip 20 is an integral part of the frame for the example shown. The user holds the pistol by wrapping one hand around grip 20—which positions the index finger of that hand in the proper location for pulling trigger 24. Barrel 16 includes firing chamber 30. When a cartridge contained within the chamber is fired, the bullet accelerates down the bore of the barrel toward the intended target.

Slide contains striker 28, which is spring-biased toward the rear. The rearmost portion of the striker is exposed so that hammer 18 can strike it—thereby propelling the striker forward so that the nose of the striker impacts the primer on the base of a cartridge in chamber 30. The impact of the striker detonates a cartridge when the weapon is fired. Lock mechanism 26—the mechanism for securing the hammer in a cocked state and precisely releasing it when the trigger is pulled—is housed generally in the area indicated by the dashed line. As the lock mechanism is not significant to the present invention, no detailed explanation for these components is provided.

For a semi-automatic pistol, the firing of a cartridge performs several actions without further user involvement. These are generally (1) propelling the slide to the rear, (2) ejecting the spent cartridge case, (3) cocking the hammer or otherwise resetting the lock system, (4) feeding a new cartridge into the chamber, and (5) closing the chamber to be ready for the next firing. FIG. 1 shows pistol 10 in the state just after a cartridge is fired. Slide 14 is fully forward and hammer 18 is in the fired position (The cartridge and bullet are not shown for purposes of visual clarity).

At this point the propellant gasses escaping from the muzzle propel barrel 16 rearward with respect to frame 12. The breech end of the barrel bears against breech face 132 and propels slide 14 rearward with the barrel. Barrel 16 includes a descending lug 38. Cross pin 32 runs laterally through slot 42 in locking body 40. The ends of the cross pin are secured to frame 12 so that it remains with the frame and does not move. As barrel 16 moves rearward, lug 38 engages the corresponding inclined surface on locking body 40. This engagement pivots the breech end of the barrel downward and propels locking body 40 rearward until the forward end of slot 42 runs into cross pin 32.

FIG. 2 shows the recoil motion just as locking body 40 is stopped in its rearward travel. At this point locking body 40 can no longer move rearward and the rearward motion of barrel 16 is also stopped by the engagement of the locking body and lug 38. However, the breech end of barrel 16 has pivoted downward far enough to disengage the barrel from slide 14. Significant momentum has been imparted to slide 14 by this point, so it continues rearward even though the barrel has stopped. The reader will note that the rearward motion of slide 14 has started to swing hammer 18 downward toward its cocked position.

Slide extension 102 extends downward from the forward portion of the slide and encompasses guide rod 34. As the slide travels rearward, spring 36 is compressed by the slide extension and stabilized by guide rod 34. Spring 36 tends to urge slide 14 forward. Thus, as the slide continues to travel rearward—as a result of momentum—spring 36 opposes this motion and decelerates the slide.

FIG. 3 shows slide 14 at the rearmost point of travel. Hammer 18 at this point is fully cocked and retained in that position by the lock mechanism. Ejection port 134 is fully open. A cartridge ejector (not shown) ejects the spent cartridge case through the open port. Spring 36 is fully compressed by slide extension 102. The motion of the slide is then reversed, with spring 36 propelling it forward until it returns to the state depicted in FIG. 1.

Those skilled in the art will appreciate that the depictions of FIGS. 1-3 are somewhat simplified. As an example, slide extension 102 will often house a compliant bushing to accommodate the barrel tilt and minimize sliding friction. Other small components have been omitted to avoid visual clutter.

The inventive firearm simulator seeks to duplicate the motions thus described, as well as providing additional features.

BRIEF SUMMARY OF THE PRESENT INVENTION

The present invention comprises an electrically powered firearm training device. There are two main components—a simulator barrel assembly and a simulator magazine assembly. The simulator barrel assembly replaces the firearm's conventional barrel. The simulator magazine assembly replaces the firearm's conventional magazine. The simulator barrel assembly includes an electric motor that controllably moves a traveler using a jackscrew. The traveler cycles the slide in order to simulate the normal operation of the firearm. Electrical power is supplied to the motor from batteries within the simulator magazine. Control and monitoring functions are preferably also provided in the simulator magazine.

REFERENCE NUMERALS IN THE DRAWINGS

Figure 1:
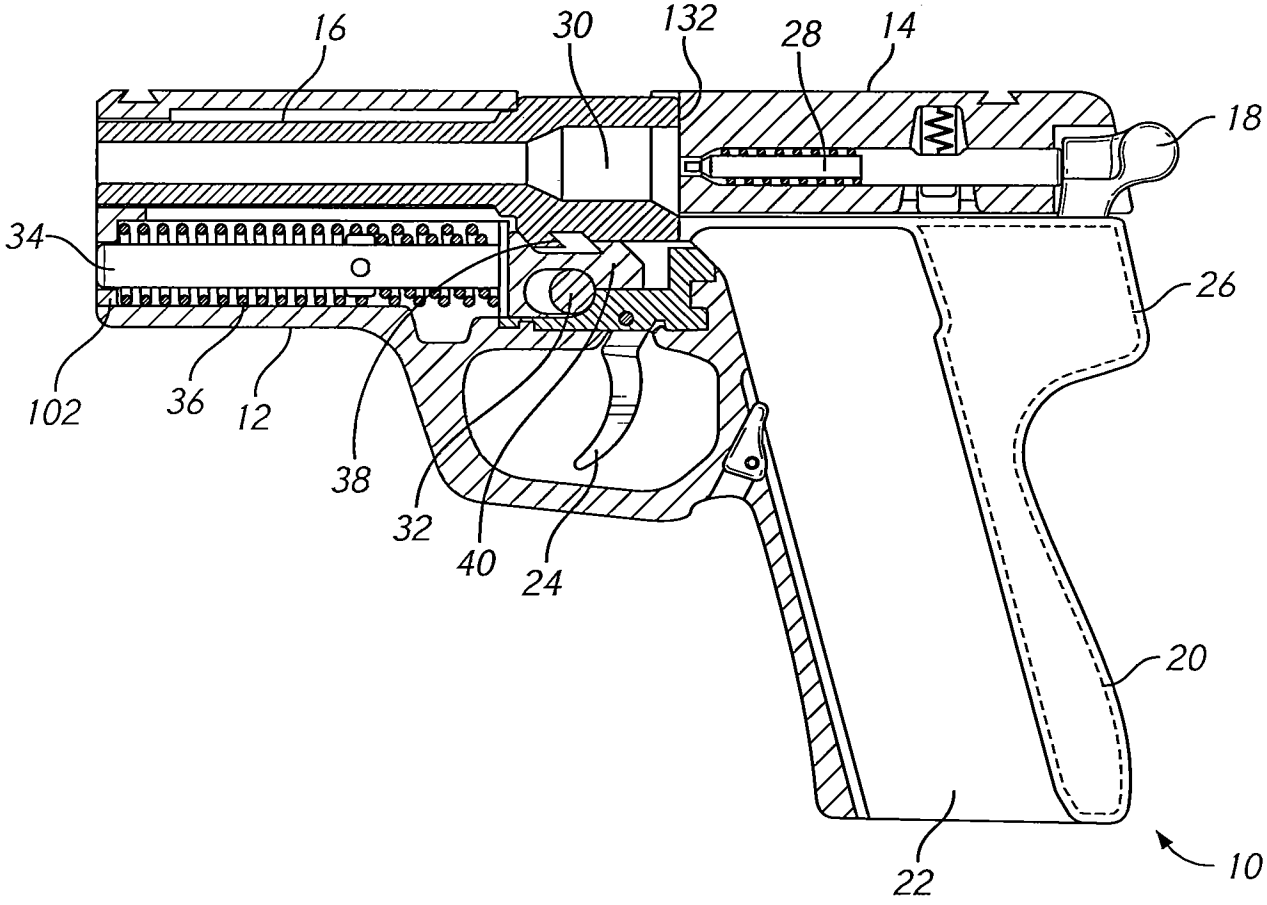
FIG. 1 (PRIOR ART)
FIG. 1 is a section view, showing internal details of a prior art pistol.

10 pistol
12 frame
14 slide
16 barrel
18 hammer
20 grip
22 magazine well
24 trigger
26 lock mechanism
28 striker
30 chamber
32 cross pin
34 guide rod
36 spring
38 lug
40 locking body
42 slot
44 simulator barrel assembly
46 simulator magazine assembly
48 lug
50 cross bore
52 tang
54 connector
56 barrel
58 motor
60 traveler
62 guide rod
64 potting
66 slot
68 base
70 tube
72 indicator
74 indicator
76 button
78 retention notch
80 actuator
82 connector
84 plane
86 proximity sensor
88 insert
90 contact
92 contact
94 contact
96 magazine latch
98 jackscrew
100 return spring
102 slide extension
104 pin
106 slot
108 contact insert
110 conductor
112 charging socket

114 battery
116 PC board
118 processor
120 power output electronics
122 slide latch
124 notch
126 motor controller
128 charge controller
130 memory
132 breech face
134 ejection port
136 contact
138 contact
140 speaker

DETAILED DESCRIPTION OF THE INVENTION

The present invention can be configured for use in a wide variety of firearms and physically realized in a wide range of embodiments. One skilled in the art—having reviewed the following detailed descriptions—will envision many more embodiments. Accordingly, the scope of the invention should be fixed by the claims rather than the specific examples provided.

Figure 2:
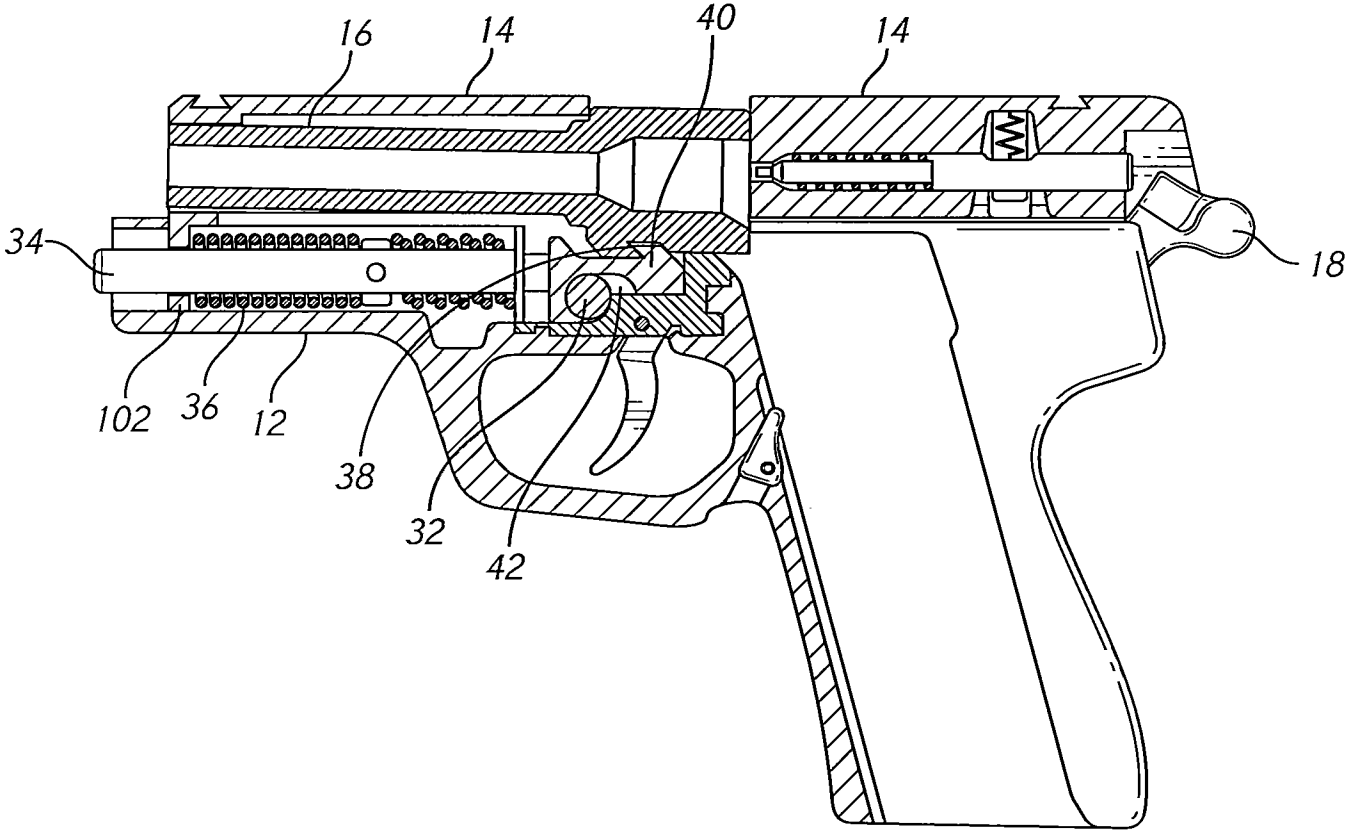
FIG. 2 (PRIOR ART)
FIG. 2 is a section view, showing internal details of a prior art pistol.
Figure 3:
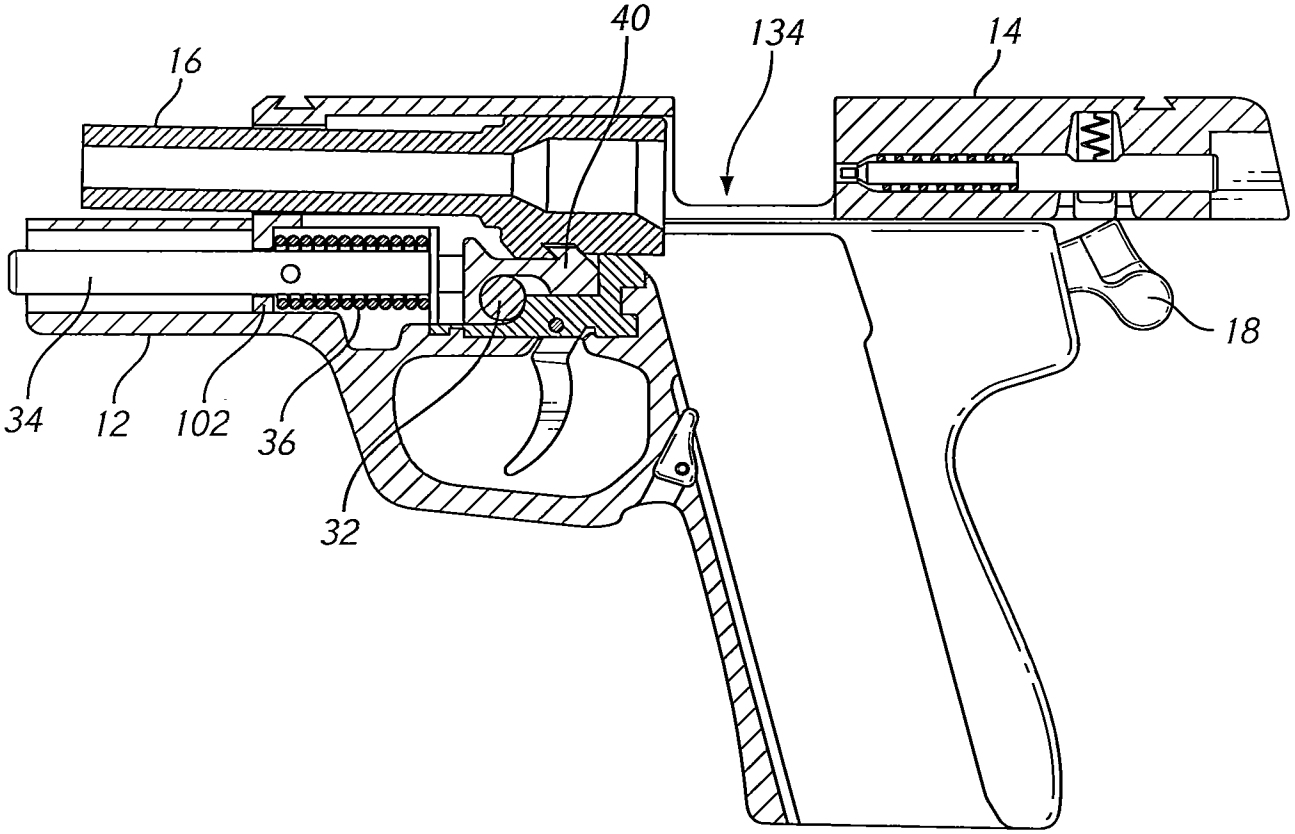
FIG. 3 (PRIOR ART)
FIG. 3 is a section view, showing internal details of a prior art pistol.

The embodiments described in the following paragraphs are designed to function with the prior art firearm depicted in FIGS. 1-3. The features described are—of necessity—configured for that particular firearm. However, it will be apparent that the embodiments described can be altered to suit the entire range of semi-automatic firearms and semi-automatic pistols in particular.

A central concept of the invention is that the training device can be added to an existing, functional firearm. It is also desirable for the firearm to be easily returned to its conventional state after the removal of the training device. In this description the term "conventional" shall mean a component that is found in the normal, operational state of a firearm. Thus, a conventional barrel is a component that includes a firing chamber and a bore. A conventional barrel receives a loaded cartridge in normal operations and contains it during the firing sequence. A conventional magazine contains multiple cartridges that are fed into the barrel as the firearm goes through the firing sequence repeatedly.

The inventive training device includes two main components—a simulator barrel assembly and a simulator magazine assembly. The simulator barrel assembly replaces the conventional barrel—typically along with a few other adjacent components. The simulator magazine assembly replaces the conventional magazine assembly.

Figure 4:
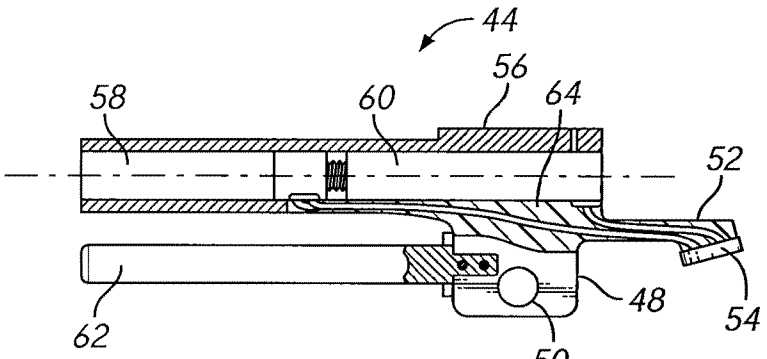
FIG. 4 is a section view, showing a simulator barrel assembly.

FIG. 4 shows an embodiment of simulator barrel assembly 44. This view is a sectional view taken vertically through the mid plane of the assembly. Barrel 56 has a hollow cylindrical bore. Motor 58 is fixedly mounted in this bore. Traveler 60 translates within the bore, along the axis shown. A jackscrew connects the motor to the traveler in an arrangement that will be familiar to those familiar with mechanical systems. The jackscrew converts the rotary motion of the motor into linear motion of the traveler. The motor therefore propels the aft end of the traveler (the aft end being on the right side in the orientation of FIG. 4) in and out of the rear of the barrel.

Tang 52 extends from the aft portion of barrel 56. Electrical connector 54 is mounted to the aft end of tang 52—facing downward. Lug 48 descends from the lower portion of the barrel. Cross bore 50 is provided through the lug, transverse to the direction of the bore of the barrel. Guide rod 62 extends forward from lug 48 in a direction that is parallel to the barrel.

Figure 5:
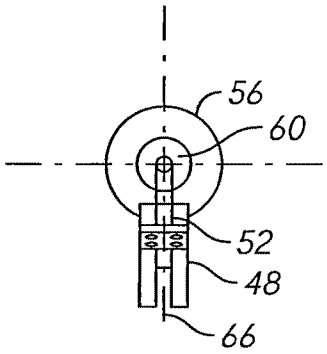
FIG. 5 is an elevation view, showing a simulator barrel assembly.

FIG. 5 shows simulator barrel assembly 44 from the aft end looking forward. The reader will note how lug 48 lies beneath barrel 56. Slot 66 is provided in lug 48. This slot extends up to the barrel and in fact passes through the lower wall of the barrel and into its interior in this example. Returning to FIG. 4, the reader will note the presence of the slot in lug 48. The slot provides clearance for the passage of electrical conductors from the motor to connector 54 (as well as some other conductors to be explained subsequently). It is preferable to secure the conductors so they do not become damaged or interfere with moving components. Accordingly, the conductors are encased in potting 64 within slot 66. The potting is preferably a durable epoxy.

Figure 6:
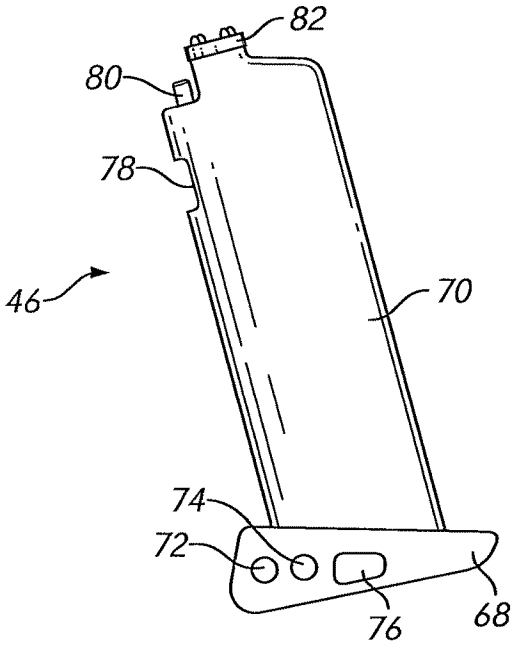
FIG. 6 is an elevation view, showing a simulator magazine assembly.

FIG. 6 shows simulator magazine assembly 46. Tube 70 is sized so slide into the magazine well of pistol 10. The reader should note that the word "tube" is traditionally used for the hollow portion of a magazine that contains the cartridges, the follower, and the follower spring. However, it is not a round shape. The cross section is generally rectangular with a rounded forward portion. The external form factor of the simulator magazine is the same as a conventional magazine—since it must interact with conventional pistol components that are designed to interact with a conventional magazine. Retention notch 78 is provided on the forward side of the simulator magazine assembly. The retention notch is positioned to be engaged by a magazine latch on the pistol—which holds the simulator magazine assembly in the installed position.

Electrical connector 82 is provided on the upper portion of the simulator magazine assembly. Base 68 is provided on the lower portion. The base in this example includes indicator lights 72,74 and a user control input (button 76).

Figure 7:
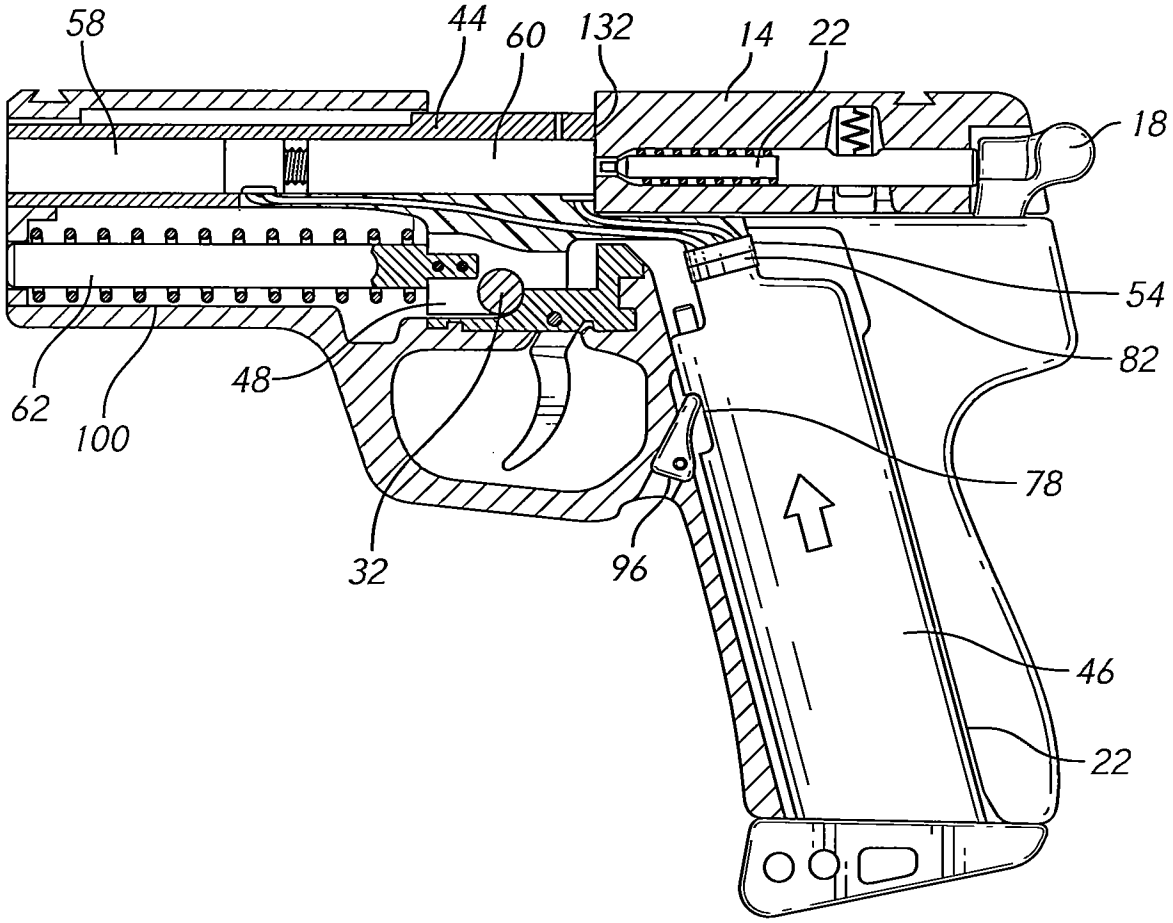
FIG. 7 is a section view, showing an embodiment of the present invention.

In order to install the invention the user must first remove some conventional components from the firearm. For the exemplary firearm of FIG. 1, the user must remove conventional slide 14, barrel 16, spring 36, cross pin 32, and locking body 40. The user then drops simulator barrel assembly 44 into position and locks it in place by replacing the conventional cross pin 32. This installed state is shown in FIG. 7. Guide rod 62 is placed in the position shown and a return spring 100 is slid over the guide rod. Conventional slide 14 is reinstalled as shown.

Simulator magazine assembly 46 is installed by sliding it up into magazine well 22 in the direction indicated by the arrow. Magazine latch 96 is spring-biased to pop into retention notch 78 and thereby retain the simulator magazine assembly in position. During the installation process of the simulator magazine assembly, electrical connector 82 on the top of the simulator magazine assembly mates to electrical connector 54 on the tang of the simulator barrel assembly. Power and control communication is thereby established between the simulator magazine assembly and the simulator barrel assembly.

In the example of FIG. 7, power is supplied from a battery or batteries within the simulator magazine assembly. Control of the overall device is also provided by a processor within the simulator magazine assembly. The operation of the invention will now be described generally, with more details to follow.

FIG. 7 shows the state of the inventive training device after it has been installed. Slide 14, striker 22, and hammer 18 are all conventional components. The user can rack the slide (cycle it to the aft most extent of travel and bring it forward again) to place the firearm in single-action mode.

The user may also elect to fire from a double-action mode in which the trigger pull first cocks the hammer and then releases it. The control electronics within the simulator magazine assembly preferably require the trainee to operate the pistol to "load" a simulated round before a simulated firing cycle is possible. This can be done in one of two ways for the firearm illustrated.

Figure 12:
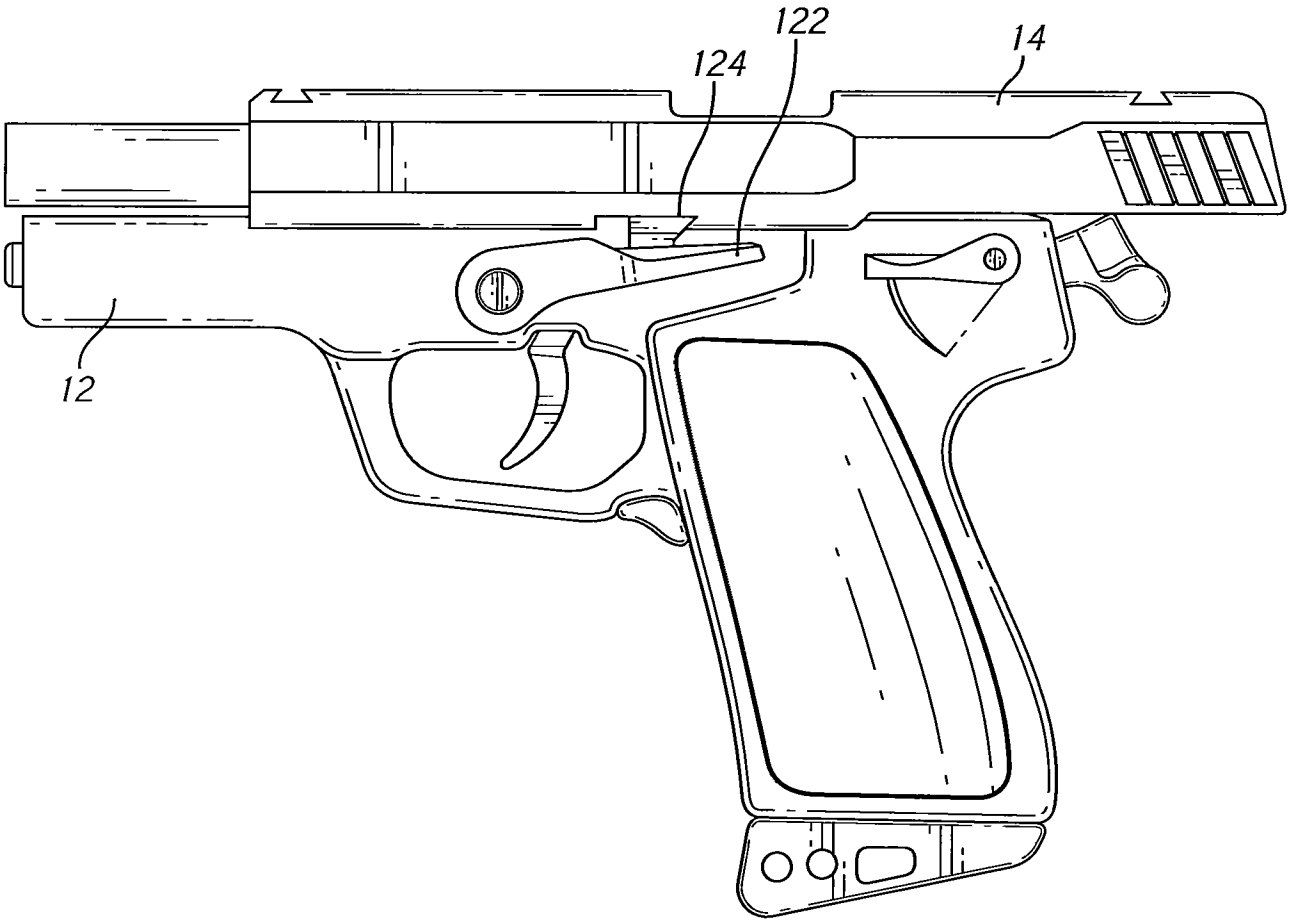
FIG. 12 is an elevation view, showing a firearm incorporating the present invention with the slide locked back.

The first scenario is when the simulator magazine assembly is loaded into the firearm when slide 14 is locked back (shown in FIG. 12). Looking at FIG. 12—the user must release slide latch 122 to allow slide 14 to travel forward and close the breech. When the user releases the slide latch and the slide travels forward, the simulator magazine assembly detects this condition and the training device is then ready to perform a simulated firing cycle.

The second scenario is when the simulator magazine assembly is placed in the firearm with the slide fully forward. This scenario is shown in FIG. 7. In this second scenario, the user must preferably rack the slide before the inventive training device is ready to perform a simulated firing cycle. When the user cycles the slide the simulator magazine assembly detects this operation.

Under either scenario, the user initiates a simulated firing cycle by pulling the conventional trigger. FIG. 7 shows the situation where hammer 18 has been actuated (by the conventional lock mechanism) to strike the rear of striker 22. The nose of the striker then travels into the rear of traveler 60. A proximity detector on the traveler detects the motion of the striker and properly interprets this as the initiation of the firing cycle. The processor within the simulator magazine assembly energizes motor 58 and the jackscrew rapidly propels traveler 60 rearward. Traveler 60 bears against breech face 132 on slide 14 and propels the slide rearward.

The reader will note that the barrel within simulator barrel assembly 44 is held in place by cross pin 32 passing through lug 48. Unlike the conventional barrel, the simulator barrel assembly does not move rearward nor does it tilt. Accordingly, the external profile of barrel 56 within the simulator barrel assembly 44 does not exactly match the external profile of the conventional barrel. Barrel 56 has external features that allow slide 14 to slide past it even when it is held in place.

Figure 8:
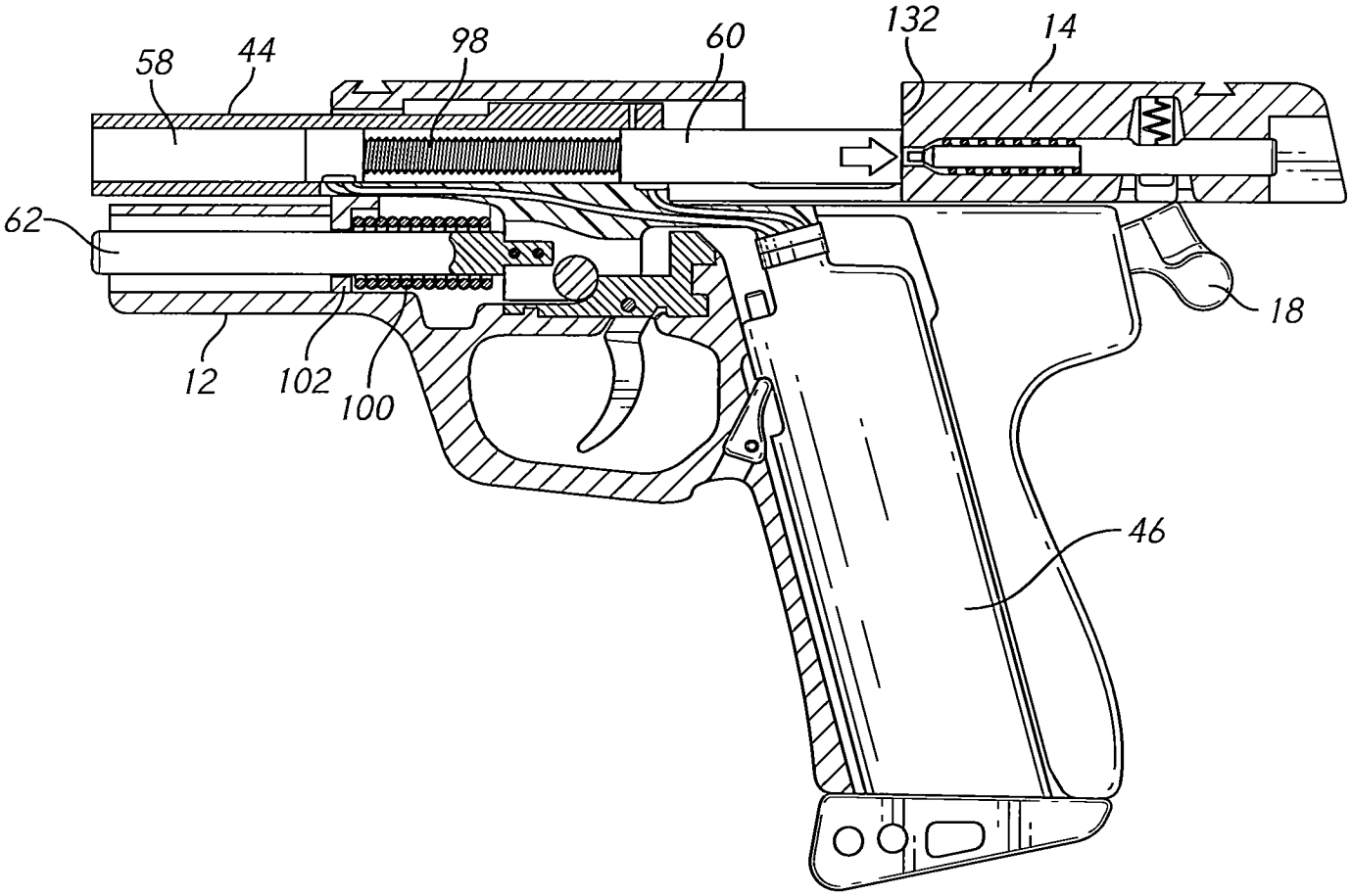
FIG. 8 is a section view, showing an embodiment of the present invention.

FIG. 8 shows the same assembly after jackscrew 98 has propelled traveler 60 to its rearmost extent of travel. Slide 14 has traveled in its normal range of motion and cocked hammer 18. Return spring 100 has been compressed by the rearward travel of slide extension 102. Motor 58 then reverses its direction of rotation and jackscrew 98 rapidly retracts traveler 60 back into the simulator barrel assembly. Return spring 100 urges slide extension 102 (and slide 14) forward until breech face 132 once again rests against the rear of the simulator barrel assembly (the position shown in FIG. 7).

The motor, jackscrew, and traveler are preferably designed to cycle quite rapidly. The entire opening and closing cycle in the example shown takes about 250 milliseconds (¼ second). This is fast enough to provide the desired training functionality.

Figure 9:
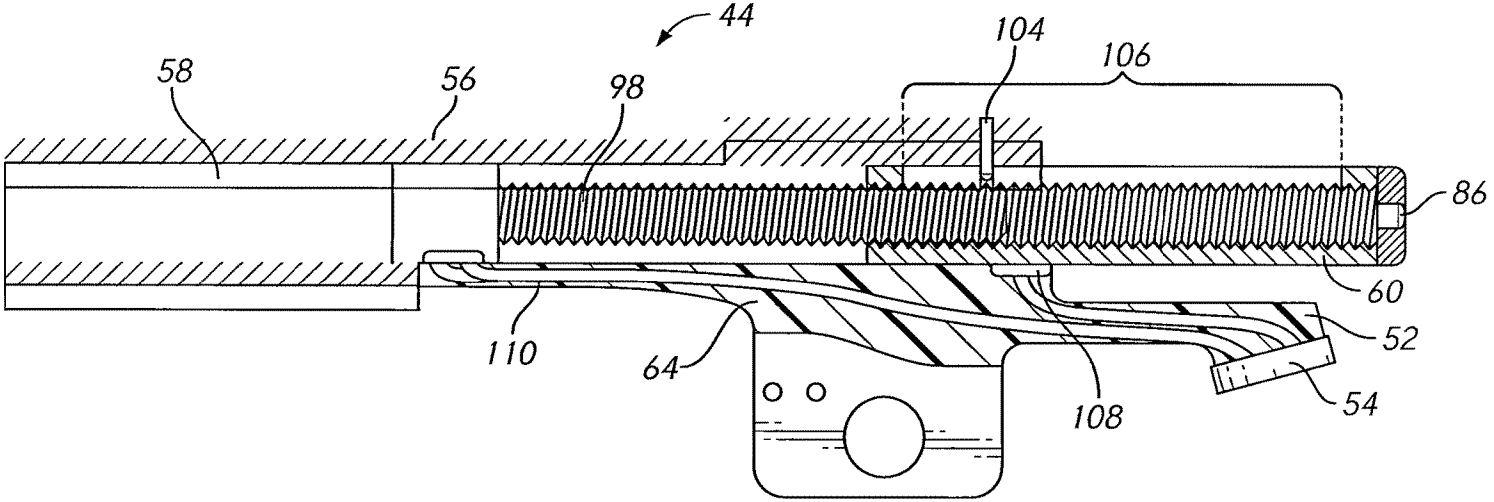
FIG. 9 is a detailed section view, showing the simulator barrel assembly.

FIG. 9 provides a more detailed view of simulator barrel assembly 44. Traveler 60 has a female thread sized to engage the male thread on jackscrew 98. It is important to limit rotation of the traveler 60. Pin 104 is provided for this purpose. Pin 104 passes through a bore in barrel 56. The lower portion of the pin protrudes into a longitudinal slot 106 in the upper portion of the traveler (directional terms such as upper, lower, etc. being understood with respect to the orientation shown in the view).

In this example, proximity sensor 86 is provided on the aft portion of the traveler. This proximity sensor—which could be mounted in other locations or even on other components—detects the motion of the striker when the trainee pulls the trigger. Contact insert 108 is provided below the traveler. This provides electrical contact pads for communicating with the proximity sensor and for other purposes. Electrical conductors connect the contact insert to connector 56 on tang 52. Conductors 110 also connect motor 58 to connector 54. As explained previously, it is preferable to place all these conductors in protective potting 64.

Figure 10:
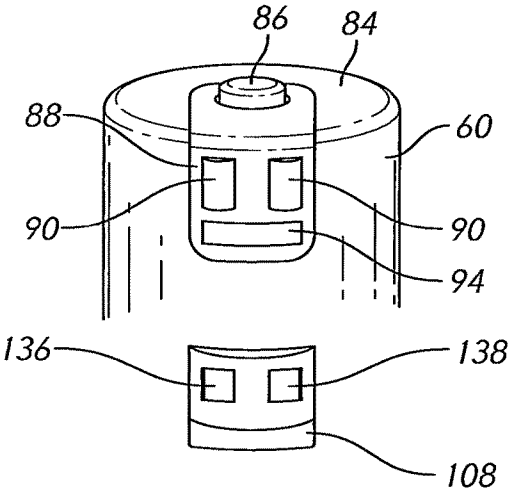
FIG. 10 is a detailed perspective view, showing a proximity sensor in the simulator barrel assembly.

FIG. 10 provides a detailed perspective view of the lower and aft portions of traveler 60. Proximity sensor 86 in this example is a simple contact switch that closes when the nose of striker contacts it. Insert 88 is made of a non-conductive material. It houses the proximity sensor, along with electrical contacts 90,92,94. Contacts 90,92,94 are positioned to interact with corresponding electrical contact on contact insert 108. Contact insert 108 is shown on its own in FIG. 10. Its position within the assembly is shown in FIG. 9.

When traveler 60 is moving forward and is almost to its "home" position (fully forward), contact 94 bridges contacts 136 and 138 on contact insert 108. This sends a first signal to the processor in the simulator magazine assembly and the processor responds by slowing and stopping the traveler in its home position. When traveler 60 is in its home position contact 90 on the traveler is touching contact 136 on the contact insert and contact 92 on the traveler is touching contact 138 on the contact insert. This configuration places proximity sensor 86 in communication with the processor in the simulator magazine assembly—as will be explained subsequently.

Figure 11:
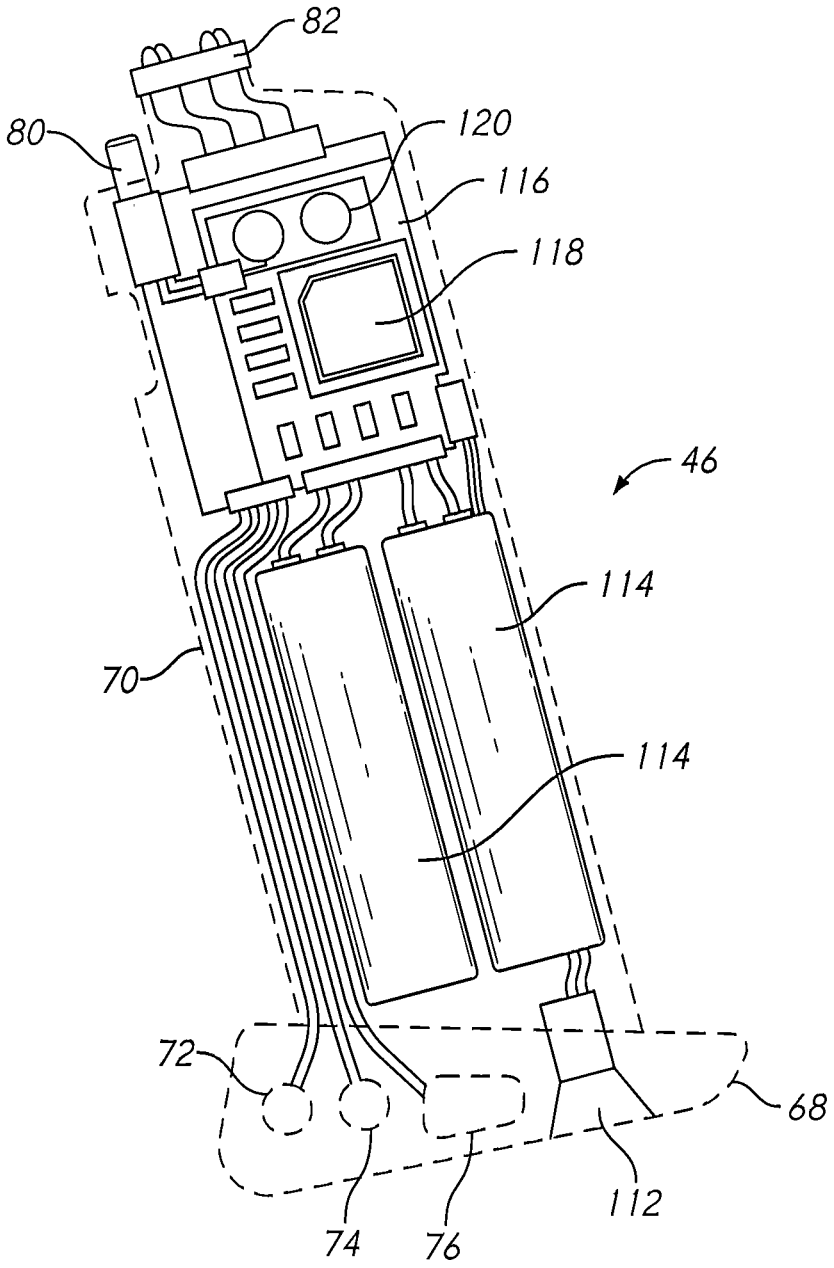
FIG. 11 is a detailed elevation view, showing the simulator magazine assembly.

FIG. 11 provides additional details of an exemplary simulator magazine assembly 46. PC board 116 preferably mounts processor 118, power output electronics 120, actuator 80, and other components. A pair of rechargeable batteries 114 provide electrical power. Charging socket 112 allows external recharging. Electrical connectors connect the PC board to connector 82, indicators 72,74, button 76, charging socket 112, actuator 80, and batteries 114.

Figure 13:
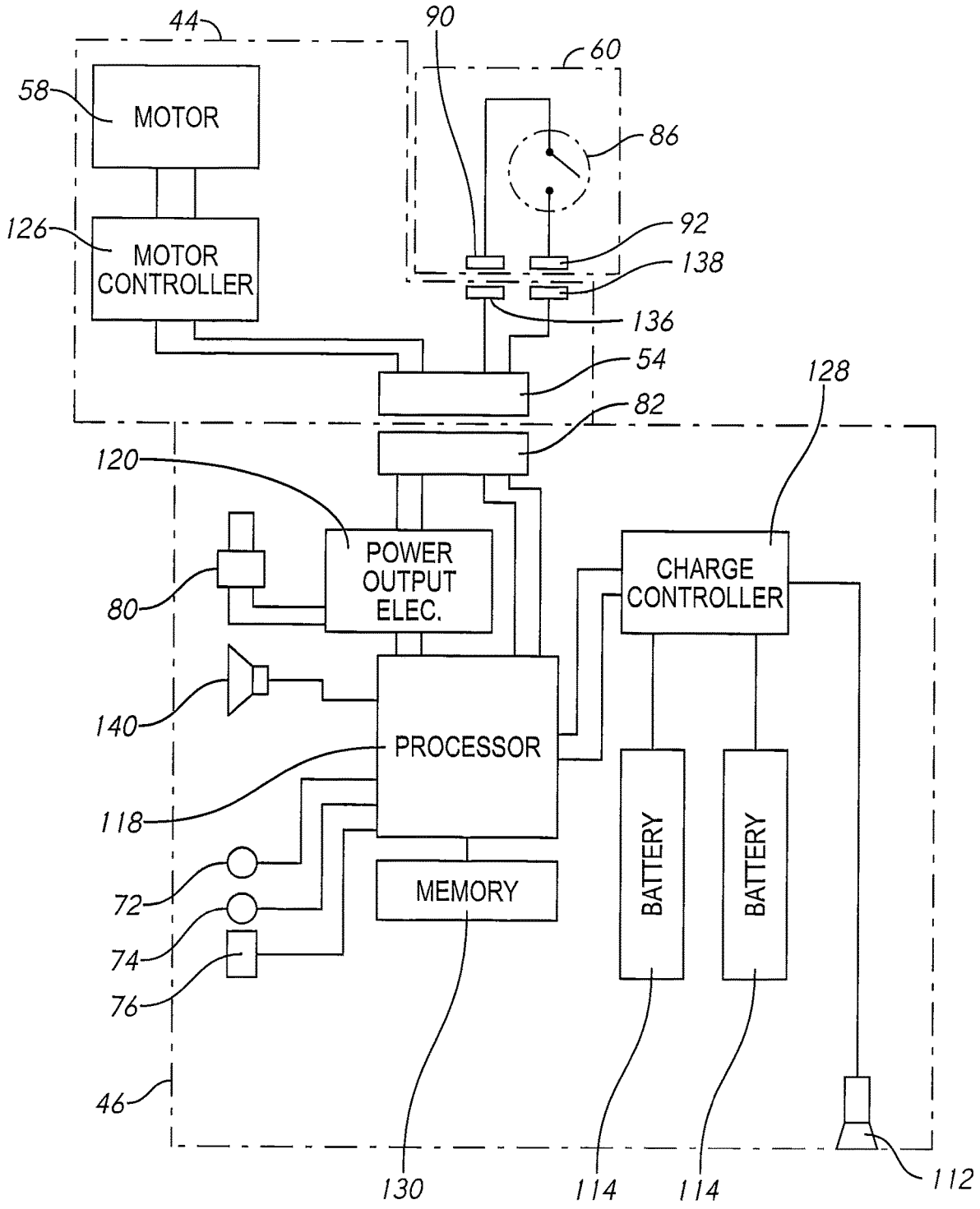
FIG. 13 is a schematic view, showing an embodiment of the control and power circuits used in the present invention.

FIG. 13 provides a simplified schematic view corresponding to the embodiments shown in FIGS. 7-12. It shows the electrical connections for components in both the simulator barrel assembly 44 and the simulator magazine assembly 46. The electrical links through the mating of connectors 54 and 86 are shown.

Processor 118 runs software retrieved from associated memory 130 to govern the operations of the training device. Proximity sensor 86 detects the firing of the weapon via detecting the motion of the striker. This closes an electrical circuit that is monitored by processor 118 (in this case the voltage on a pin is pulled to ground and this is interpreted as the detection of a firing event). Processor 118 then provides a power and control signal to motor controller 126 via power output electronics 120. Motor controller 126 energizes motor 58 and drives it to move the traveler rearward.

The motor in this example includes a simple rotary encoder that sends pulses to the motor controller. The motor controller counts these pulses on the rearward stroke for the traveler until a predetermined number of pulses has been reached. The motor controller then reverses the direction of the motor to retract the traveler.

The motor controller can operate simply by counting pulses from the rotary encoder—stopping when the same predetermined number of pulses has been reached on the return stroke. As an additional control method, the processor monitors contacts 136 and 138 during the return stroke.

Looking briefly at FIG. 10, the reader will recall that contact 94 on the traveler bridges contacts 136 and 138 on contact insert 108 just before the traveler reaches its home position. The motor controller is programmed to stop the motor a set number of pulses after the bridging event is caused by contact 94. This ensures the proper home position for the traveler. Once the traveler's home position is reached, processor 118 returns to monitoring contacts 136 and 138 in order to detect the next firing event.

Processor 118 also interacts with charge controller 128, which is preferably located on the same PC board. Charge controller 128 monitors the condition of batteries 114 and regulates the recharging of the batteries when an external power source is connected to charging socket 112.

Processor 118 controls the operation of visual indicators 72 and 74. These can be LEDs. One or more can also be a graphical display that is configured to displays numbers and text. User input 76—a push button in this example—is also monitored by processor 118. When the input is activated by the user, the processor detects this action and can respond. Speaker 140 is also provided. The processor in this example has an integrated audio output unit that can use the speaker to produce sounds.

Processor 118 also controls the operation of actuator 80 through power output electronics 120. In this example actuator 80 is a solenoid with a moving plunger that extends upward when activated. The physical location of actuator 80 is shown in FIG. 6 and FIG. 11. The purpose of this actuator is to activate a conventional slide latch in order to hold the conventional slide open.

FIG. 12 shows this state. Slide latch 122 has been pivoted upward so that an upstanding portion of the slide latch engages notch 124 on slide 14 and holds the slide in the rearward position shown. In order to disengage the slid latch, the user must press down on it. The conventional slide latch has a protrusion located inside the pistol—in the upper part of the magazine well. With a conventional pistol magazine, the conventional magazine follower pushes upward on this protrusion when the last round in the magazine is fired (thereby latching the slide in its rearward position). This feature assumes various forms, but it is common to most every semi-automatic pistol (see U.S. Pat. No. 984,519 for example). It is preferable to simulate the activation and release of a slide latch in firearm training. Thus, the embodiments depicted include actuator 80 to trip the conventional slide latch. This will ordinarily be done when the last "simulated round" is fired.

The inventive embodiment thus described can be programmed to operate in many different ways. It is helpful to consider a few examples of this programmed operation.

Example One

The training device is set to simulate the operation of a semi-automatic pistol having a magazine capacity of 15 rounds. The processor detects when the simulator magazine assembly is first loaded into the pistol via an initial interaction with motor controller 126 (a simple limit switch can also be used). The processor at that point sets the magazine count to the defined value (15 rounds). The processor records each firing cycle and deducts that value from the magazine count. When the processor detects the initiation of the 15th and final cycle, it actuates actuator 80 when the traveler is nearing the rearward portion of its stroke and holds the actuator in its extended position for a brief interval—long enough to engage slide latch 122 and hold slide 14 in its latched position (see FIG. 12).

This action visually alerts the user that the magazine has been expended. In this example, multiple identical instances of simulator magazine assembly are available. The user responds by actuating the conventional magazine latch—releasing the "spent" magazine. The user then places a new simulator magazine assembly in the magazine well and resumes the operation.

The batteries in a simulator magazine assembly will ordinarily endure through many "15 round" cycles before they need to be recharged. It is therefore helpful to allow the user to reset a magazine to the full state for training. This can be done in many ways. Looking at FIG. 6, the processor can be programmed so that a user pressing button 76 while the assembly is removed from the firearm resets the magazine count.

Example Two

Part of the training for operating a semi-automatic firearm is learning to deal with a jam. The processor can be programmed to randomly generate a simulated jam. As an example, the traveler can be actuated halfway to its normal rearward extent. The user must then press button 76 to "clear the jam" and resume normal operations.

Example Three

In some instances the training session will not involve counting rounds and replacing magazines. For this case the processor can be programmed to permit continuous operation, where the firearm can be cycled hundreds of times without removing the simulator magazine assembly (subject only to battery life).

Example Four

Trainees are sometimes taught to "top off" a partially expended magazine during a lull in the action. For this case the processor can be programmed to add rounds to its count when button 76 is pressed while the simulator magazine assembly is removed from the firearm. The processor adds a round for each time the button is pressed.

Selecting an operating mode can be carried out via indications on indicators 72,74 and pressing button 76. A separate programming jack can also be provided. Wireless communication with the processor is another option. Other features are possible including, without limitation:

1. The use of flashing indicators are audio "beeps" to indicate a status to the user;
2. A proximity sensor based on optical effects or the Hall effect—rather than a contact switch;
3. A "rounds remaining" graphical display that is visible to the user; and
4. The placement of the controlling processor and memory in the simulator barrel assembly rather than the simulator magazine assembly.

Although the preceding description contains significant detail, it should not be construed as limiting the scope of the invention but rather as providing illustrations of the preferred embodiments of the invention. Numerous other permutations and modifications will be apparent to those skilled in the art. Thus, the scope of the invention should be fixed by the following claims rather than the examples given.

Having described my invention, I claim:

1. An electrically-powered firearm training device for use in a firearm having a frame, a reciprocating slide attached to said frame, a striker within said slide, a magazine well, and a slide latch, comprising:

(a) a simulator barrel assembly installed in said firearm in a position ordinarily occupied by a conventional barrel, including,
  (i) a barrel,
  (ii) a motor mounted in a forward portion of said barrel,
  (iii) a traveler slidably mounted in an aft portion of said barrel,
  (iv) a jackscrew connecting said motor to said traveler, so that rotary motion of said motor produces linear motion of said traveler,
  (v) a tang protruding rearward from said barrel to an upper portion of said magazine well,
  (vi) a first electrical connector mounted on said tang,
  (vii) a proximity sensor mounted on an aft portion of said traveler, said proximity sensor being configured to detect forward motion of said slider when said firearm is fired,
  (viii) electrical conductors connecting said motor and said proximity detector to said first electrical connector;

(b) a simulator magazine assembly installed in said magazine well in said firearm, including,
  (i) a second electrical connector configured to mate with said first electrical connector when said simulator magazine is installed in said magazine well,
  (ii) a processor having an associated memory, said processor running software retrieved from said memory to control the operations of said firearm training device,
  (iii) a rechargeable battery,
  (iv) an actuator positioned to activate said slide latch on said firearm;

(c) said processor being configured to detect via said proximity sensor the forward motion of said striker and—in response thereto—said processor driving said motor to propel said traveler through an aft and forward cycle to cycle said slide;

(d) said processor being configured to count firing cycles since a time when said simulator magazine is first installed in said magazine well; and (e) said processor being configured to—upon the detection of a predetermined number of firing cycles—actuate said actuator in order to activate said slide latch on said firearm.

2. The electrically-powered firearm training device for use in a firearm as recited in claim 1, further comprising a rotation-limiting connection between said barrel and said traveler.

3. The electrically-powered firearm training device for use in a firearm as recited in claim 1, further comprising a charging connection for charging said battery in said simulator magazine assembly.

4. The electrically-powered firearm training device for use in a firearm as recited in claim 1, further comprising a second simulator magazine assembly, whereby said second simulator magazine assembly can be substituted for said simulator magazine assembly.

5. The electrically-powered firearm training device for use in a firearm as recited in claim 1, further comprising an indicator on said simulator magazine assembly, said indicator configured to indicate a status of said simulator magazine assembly.

6. The electrically-powered firearm training device for use in a firearm as recited in claim 1, further comprising a user control input on said simulator magazine assembly, said user control input allowing the user to alter a status of said firearm training device.

7. The electrically-powered firearm training device for use in a firearm as recited in claim 1, further comprising said processor being configured to actuate said actuator in order to activate said slide latch on said firearm and thereby randomly simulate a jammed condition.

8. The electrically-powered firearm training device for use in a firearm as recited in claim 6, further comprising said processor being configured to actuate said actuator in order to activate said slide latch on said firearm and thereby randomly simulate a jammed condition, whereafter said user must actuate said user control input in order to restore normal operation.

9. The electrically-powered firearm training device for use in a firearm as recited in claim 1, wherein said second electrical connector is configured to mate to said first electrical connector when said simulator magazine assembly slides into said magazine well.

10. The electrically-powered firearm training device for use in a firearm as recited in claim 1, wherein said simulator barrel assembly includes a barrel lug, a guide rod attached to said barrel lug, and a return spring mounted on said guide rod.

11. An electrically-powered firearm training device for use in a firearm having a frame, a reciprocating slide attached to said frame, a striker within said slide, a magazine well, and a slide latch, comprising:

(a) a simulator barrel assembly installed in said firearm in a position ordinarily occupied by a conventional barrel of said firearm, including,
  (i) a motor,
  (ii) a traveler,
  (iii) a jackscrew connecting said motor to said traveler, so that rotary motion of said motor produces linear motion of said traveler,
  (iv) a first electrical connector,
  (v) a proximity sensor mounted on an aft portion of said traveler, said proximity sensor being configured to detect forward motion of said slider when said firearm is fired,
  (vi) electrical conductors connecting said motor and said proximity detector to said first electrical connector;

(b) a simulator magazine assembly installed in said magazine well in said firearm, including,
  (i) a second electrical connector configured to mate with said first electrical connector when said simulator magazine is installed in said magazine well,
  (ii) a processor having an associated memory, said processor running software retrieved from said memory to control the operations of said firearm training device,
  (iii) a battery,
  (iv) an actuator positioned to activate said slide latch on said firearm;

(c) said processor being configured to detect via said proximity sensor the forward motion of said striker and—in response thereto—said processor driving said motor to propel said traveler through an aft and forward cycle to cycle said slide;

(d) said processor being configured to count firing cycles since a time when said simulator magazine is first installed in said magazine well; and (e) said processor being configured to—upon the detection of a predetermined number of firing cycles—actuate said actuator in order to activate said slide latch on said firearm.

12. The electrically-powered firearm training device for use in a firearm as recited in claim 11, further comprising a rotation-limiting connection between said barrel and said traveler.

13. The electrically-powered firearm training device for use in a firearm as recited in claim 11, further comprising a charging connection for charging said battery in said simulator magazine assembly.

14. The electrically-powered firearm training device for use in a firearm as recited in claim 11, further comprising a second simulator magazine assembly, whereby said second simulator magazine assembly can be substituted for said simulator magazine assembly.

15. The electrically-powered firearm training device for use in a firearm as recited in claim 11, further comprising an indicator on said simulator magazine assembly, said indicator configured to indicate a status of said simulator magazine assembly.

16. The electrically-powered firearm training device for use in a firearm as recited in claim 11, further comprising a user control input on said simulator magazine assembly, said user control input allowing the user to alter a status of said firearm training device.

17. The electrically-powered firearm training device for use in a firearm as recited in claim 11, further comprising said processor being configured to actuate said actuator in order to activate said slide latch on said firearm and thereby randomly simulate a jammed condition.

18. The electrically-powered firearm training device for use in a firearm as recited in claim 16, further comprising said processor being configured to actuate said actuator in order to activate said slide latch on said firearm and thereby randomly simulate a jammed condition, whereafter said user must actuate said user control input in order to restore normal operation.

19. The electrically-powered firearm training device for use in a firearm as recited in claim 11, wherein said second electrical connector is configured to mate to said first electrical connector when said simulator magazine assembly slides into said magazine well.

20. The electrically-powered firearm training device for use in a firearm as recited in claim 11, wherein said simulator barrel assembly includes a barrel lug, a guide rod attached to said barrel lug, and a return spring mounted on said guide rod.

* * * * *